US006185768B1

(12) United States Patent
Schlechter

(10) Patent No.: US 6,185,768 B1
(45) Date of Patent: Feb. 13, 2001

(54) FEMALE CUSHION SUPPORT

(76) Inventor: Amanda Parks Schlechter, 13723 Cromer Ct., Wellington, FL (US) 33414

( * ) Notice: Under 35 U.S.C. 154(b), the term of this patent shall be extended for 0 days.

(21) Appl. No.: 09/318,459

(22) Filed: May 25, 1999

(51) Int. Cl.[7] ..... A47C 20/00
(52) U.S. Cl. ..... 5/632; 5/735; 5/930
(58) Field of Search ..... 5/632, 735, 630, 5/930; D6/601, 596

(56) References Cited

U.S. PATENT DOCUMENTS

| | | |
|---|---|---|
| D. 204,443 | 4/1966 | Wood . |
| D. 212,085 | 8/1968 | Fulkerson et al. . |
| D. 220,823 | 5/1971 | Howe . |
| D. 308,788 | 6/1990 | Boehm . |
| D. 309,542 | 7/1990 | Glenn . |
| D. 319,700 | 9/1991 | Michelson . |
| D. 357,538 | 4/1995 | Sockwell et al. . |
| D. 357,740 | 4/1995 | Kennemore . |
| D. 364,464 | 11/1995 | Gigante et al. . |
| D. 403,194 | 12/1998 | Thurston . |
| D. 410,168 | 5/1999 | McWhorter . |
| 1,537,414 | 5/1925 | Darling . |
| 1,548,728 | 6/1923 | Milam . |
| 2,182,861 | 12/1939 | Albert . |
| 2,251,530 | 9/1950 | McGuffage . |
| 3,287,747 | 11/1966 | Ellsworth . |
| 3,967,335 | 7/1976 | Rhoads . |
| 3,988,793 | 11/1976 | Abitbol . |
| 4,489,452 | 12/1984 | Lickert . |
| 4,596,384 | 6/1986 | Blossser . |
| 4,737,999 | 4/1988 | Halverson . |
| 4,819,287 | 4/1989 | Halverson . |
| 4,944,059 | 7/1990 | Wall . |
| 5,014,375 | 5/1991 | Coonrad . |
| 5,081,728 | 1/1992 | Skinner . |
| 5,095,569 | 3/1992 | Glenn . |
| 5,297,303 | 3/1994 | Stafford et al. . |
| 5,400,449 | 3/1995 | Satto . |
| 5,412,824 | 5/1995 | Emerson et al. . |
| 5,425,147 | 6/1995 | Supplee et al. . |
| 5,479,667 * | 1/1996 | Nelson et al. ..... 5/632 X |
| 5,566,682 | 10/1996 | Yavitz . |
| 5,652,981 | 8/1997 | Singer-Leyton et al. . |
| 5,661,860 | 9/1997 | Heitz . |
| 5,720,061 | 2/1998 | Giori et al. . |

* cited by examiner

*Primary Examiner*—Terry Lee Melius
*Assistant Examiner*—James M Hewitt
(74) *Attorney, Agent, or Firm*—Akerman Senterfitt

(57) ABSTRACT

A cushion support to be placed on a bed or other horizontal support surface which allows a woman to lie or sleep in a face-down position without exerting pressure on the breasts. The cushion support includes an elongated block of foam material, the front section of which is horizontally oriented and supports the upper rib cage and the sternum of the user, and a wedge-shaped lower section which supports the torso of the user. Vertically oriented arcuate recesses are provided to accommodate the breasts. When lying in a face-down position, the breasts of the user depend downwardly into the recesses without contacting the underlying support surface or the cushion support. The device is particularly designed to be used after surgical procedures to the breasts, such as breast implantations or breast reductions. A second preferred embodiment includes a substantially wedge-shaped elongate portion of foam rubber material having a planar lower face to be placed on a horizontal surface, a vertically oriented front face, two vertically oriented side faces, and a planar top face inclined at a angle of approximately 45°. Contoured recesses are provided in the front face to support the breasts.

12 Claims, 4 Drawing Sheets

FEMALE CUSHION SUPPORT

BACKGROUND OF THE INVENTION

1. Field of the Invention

This invention relates to cushions to support the human body, and in particular to a cushion designed to accommodate the breasts of a woman while lying in a prone, face-down, position, either after breast surgery or at anytime, it being recognized that enlargement procedures might create a long term need for accessory accommodation.

2. Description of the Prior Art

Many women undergo surgical procedures to the breast, such as breast enlargements utilizing implants, breast reductions, breast reconstruction, and other surgical procedures. After such surgery to the breasts, and particularly in the case of breast implants, it is often uncomfortable for a woman to lie or sleep in a face-down position. Lying on the stomach after breast surgery may, in fact, create pressure on the breasts which may be a hindrance to proper healing. There is, therefore, a long-standing need for a cushion which will allow a woman to comfortably lie in a prone position after breast surgery without causing undue compression of the breasts.

There are many examples in the prior art of cushions or mattresses which include recesses in the obvious configuration to accommodate the breasts of a woman. Rhoads, U.S. Pat. No. 3,967,335, discloses a rectangular foam rubber cushion of uniform depth in which two holes have been cut through the material so as to receive the breasts of a woman lying face down. Howe et al, U.S. Pat. No. D220,823, similarly discloses a pillow having an inclined surface to support the torso in which conical cavities have been included for the breasts of a woman. The pillow disclosed by Howe et al. is not particularly suitable for use after surgery, and fails to offer the "ledge effect" as contemplated by the pillow described herein. Unless constructed in a size specific to the individual, the shape of the conical cavities will cause constraining pressures on the breasts, for example from contact with the bottom of the cavities, and as well as from the sides. Further, if appropriately larger cavities are to be provided to comfortably accommodate the breasts without constriction, the structural integrity of the pillow due to the removal of the supporting foam material will be affected, resulting in a cushion that will easily collapse when used.

Yavitz, U.S. Pat. No. 5,566,862, discloses a therapeutic support device designed specifically to accommodate a woman's chest while lying in face down position after breast surgery. In use, this device is placed between the neck and the breasts to support the sternum, scapula and shoulders. As a result, the user's breasts are urged downward. This downward pressure on the breasts can be particularly uncomfortable for a woman who has recently undergone breast surgery.

It can be appreciated that there remains a need for a cushion support which will allow a woman to comfortably lie or sleep face down without placing undue pressure on the breasts. This need may be greater on a long term basis for a woman who has received breast implants, or on a short term basis for a woman who has had breast surgery.

SUMMARY OF THE INVENTION

It is an object of the invention to provide a cushion support for the torso of a woman lying in a face-down position which will comfortably accommodate the breasts of the woman.

It is another object of the invention to provide a cushion support for a woman who has undergone breast surgery, particularly breast implantation, which will allow the woman to lie or sleep comfortably in a face-down position.

It is still another object of the invention is to provide a cushion support for a woman lying in a face-down position which will not exert pressure on, or otherwise, constrain the breasts of the woman.

Yet another object of the invention is to provide a cushion support for a woman lying in a face-down position which is lightweight and portable, and therefore convenient to use.

It is still a further object of the invention to provide a cushion support for a woman lying in a face-down position which can be conveniently used in conjunction with a bed or other support surface.

In accordance with the above objects, a cushion support for a woman lying in a prone position has been designed. The cushion support essentially comprises an elongate block of foam rubber material which extends from the sternum to the pelvis of the user. The anterior portion of the cushion support includes curvilinear recesses to accommodate the breasts of a woman lying in a face down position, and a central mass to support the sternum of a woman lying in such a position. The top face has upper and lower sections, the intersection of which is positioned at the upper rib cage immediately below the breasts of the user. The upper section of the top face is horizontally oriented, and the lower section slopes downwardly from the intersection of the upper and lower sections so as to converge with the posterior edge of the bottom face.

While the user is lying in a prone position on a mattress or other such surface, the cushion support is positioned so as to align the recesses with the upper rib cage just below the breasts. The head of the user is supported by a pillow, or other similar head support means. The breasts of the user depend into the recesses, and are thereby suspended perpendicularly downward from the body without coming into contact with the support surface or the cushion support itself. In this way, the user can lie in a face down position without exerting any pressure or constraints on the breasts which may cause discomfort.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
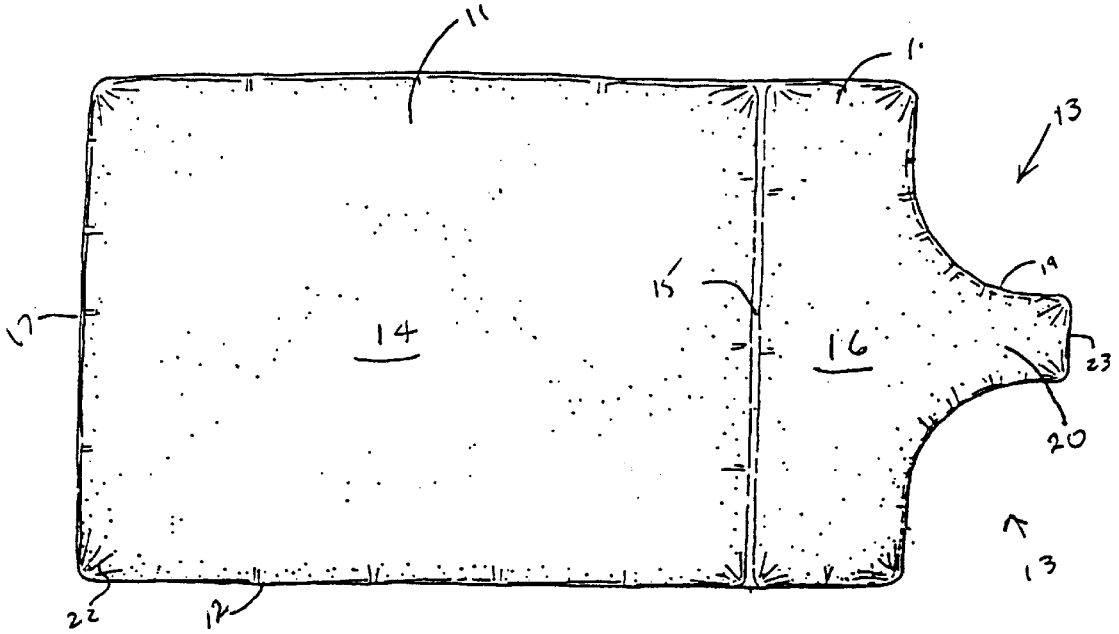
FIG. 1 is a top plan view of a cushion support for a woman according to the preferred embodiment of the invention.
Figure 2:
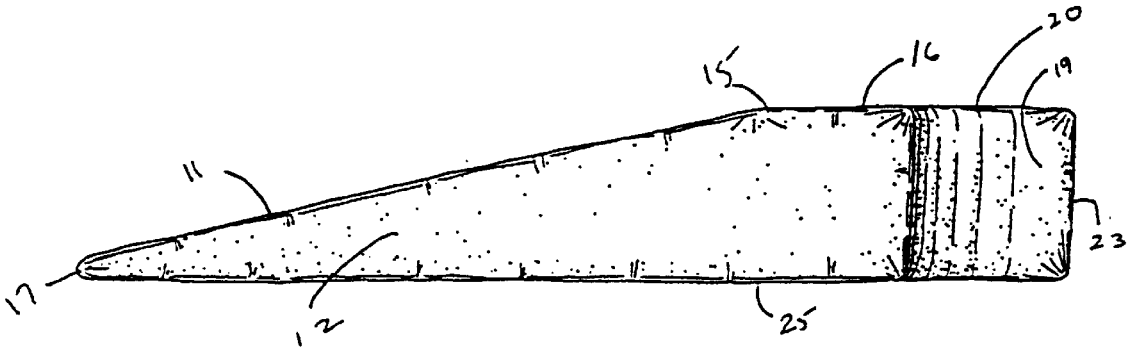
FIG. 2 is a side elevational view of the cushion support shown in FIG. 1.
Figure 3:
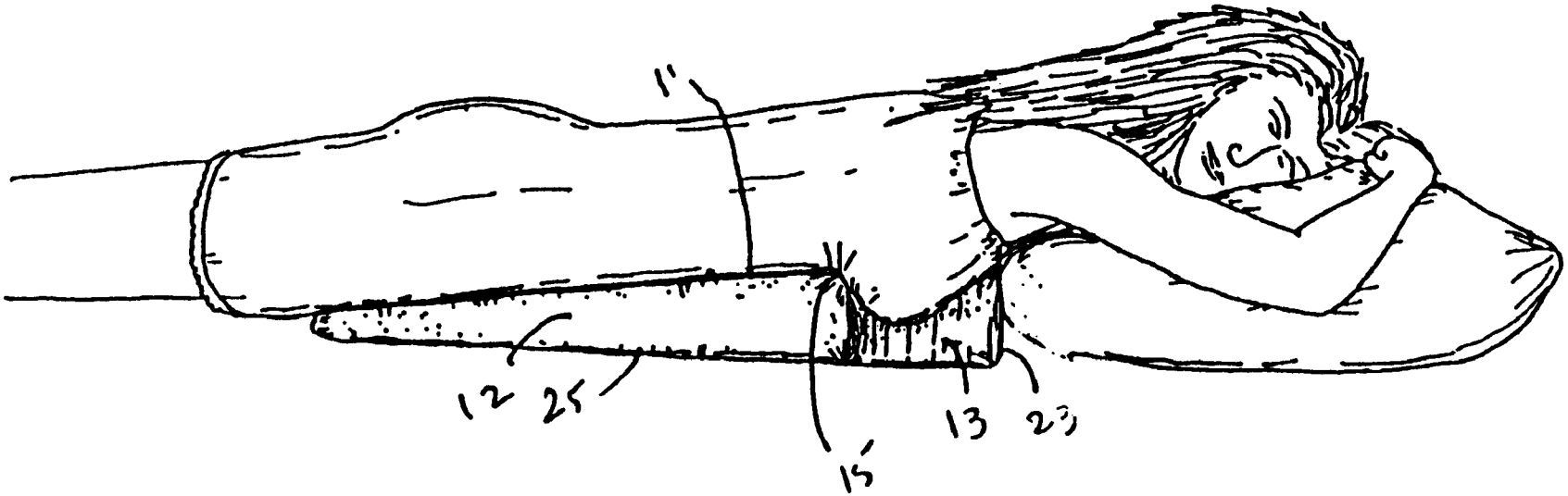
FIG. 3 is a side view of the cushion support in FIG. 1 illustrating the cushion support in use by a person lying on in prone position.

A cushion support 10 for a woman lying in a prone position is shown in FIGS. 1–3. The cushion support 10 is comprised of a foam rubber material, or other suitable materials which approximate the pliability and relative firmness of foam rubber, such as polyurethane foam or other synthetic plastic material. The firmness of the material should be chosen to provide a cushion support which will retain its basic shape in use and not be significantly compressed by the weight of the body of the user.

The cushion support has a flat lower surface 25 and long vertically oriented side surfaces 12. A continuous top surface 11 is comprised of two adjoining planar surfaces, upper rib cage support surface 16 and lower torso support surface 14, the intersection of which defines edge 15. Upper rib cage support surface 16 is horizontally oriented. Lower torso support surface 14 slopes linearly downward from edge 15 to converge with lower surface 25 at posterior edge 17 and, as shown in FIG. 2, the lower portion of cushion support 10 is therefore substantially wedge-shaped. Vertically oriented contoured recesses 13 are located at the opposite side edges of front face 23. Each recess 13 is defined by a continuous curvilinear vertical surface which perpendicularly intersects front face 23 and side surface 12. Recesses 13 are spaced to allow an adequate intervening area to support the breastbone, or sternum, of the user. A central mass or horizontally oriented protrusion is thus defined in front face 23 between recesses 13 which comprises sternum support 20.

It will be appreciated the overall dimensions of the cushion support 10 should be adequate to support the body of the user while lying in a face down position. Specifically, upper rib cage support surface 16 must be of a size sufficient to accommodate the upper body of the user and allow the breasts to depend into recesses 13. The height of upper rib cage support surface 16 should be sufficient for the foam rubber material to provide support for the weight of the body of the user, while allowing the breasts to be freely suspended without contacting the underlying support surface. In the preferred embodiment, the lower torso support surface 14 is dimensioned to support the torso of the user from the area just beneath the breasts to the pelvis of the user, however in alternative embodiments of the invention, the length of lower torso support surface 14 may be shortened or extended without negatively affecting the functionality of the cushion support.

FIG. 3 illustrates a woman lying in a prone position on a cushion support 10 of the present invention. In use, the cushion support 10 is placed on a bed or any other desired horizontal support surface. When lying face-down, the cushion support 10 is positioned beneath the user in such a way that edge 15 is located below the breast line at the upper rib cage, and is then placed in the optimum position to allow the breasts to depend comfortably into recesses 13. Due to the configuration of recesses 13, the upper body of the user is supported primarily by the upper rib cage support portion 33, while the protruding sternum support section 20 situated between the breasts provides added support at the sternum of the user. As illustrated in FIG. 3, a pillow or other suitable support means is used in conjunction with the cushion support 10 to support the upper anterior thorax area, the collar bone, the neck, and head of the user. The torso of the user is supported by the downwardly sloping lower torso support section 14.

As is shown in FIG. 3, while the user is lying in a prone position on cushion support 10, the breasts of the user are suspended into recesses 13 in such a way the breasts do not come in contact with the underlying support surface, and pressure is not exerted on the breasts by the underlying support surface or the surface of cushion support 10 itself. By allowing the breasts to be freely suspended from the body, the breasts are not constrained or compressed in any way while the individual is lying in a prone position. It is recognized that minimal control of the breasts with the modifying support surface or with cushion support 10 will not defeat the objectives of the invention.

In view of the foregoing, it is seen that the present invention provides a comfortable and convenient means for a woman who has undergone breast surgery, such as breast implants, breast reduction, breast reconstruction, etc., to lie or sleep in a prone position without exerting pressure on the operated areas. Use of the invention is not limited to post-operative patients, and may be useful in other circumstances, such as where a large breast size may interfere with the ability of an individual to lie face down comfortably under normal circumstances.

In the preferred embodiment, a fabric cover 22 is provided which conforms to the shape of the cushion support 10. The fabric cover can be any soft woven washable material, such as cotton or cotton-polyester blend fabrics typically used for bedding. In an alternative arrangement, an aperture may be provided in the fabric cover which will allow the removal of the fabric cover from the cushion support 10 in order to facilitate laundering of the fabric cover. The aperture may be opened and closed by a zipper, or other similar fastening means.

Figure 4:
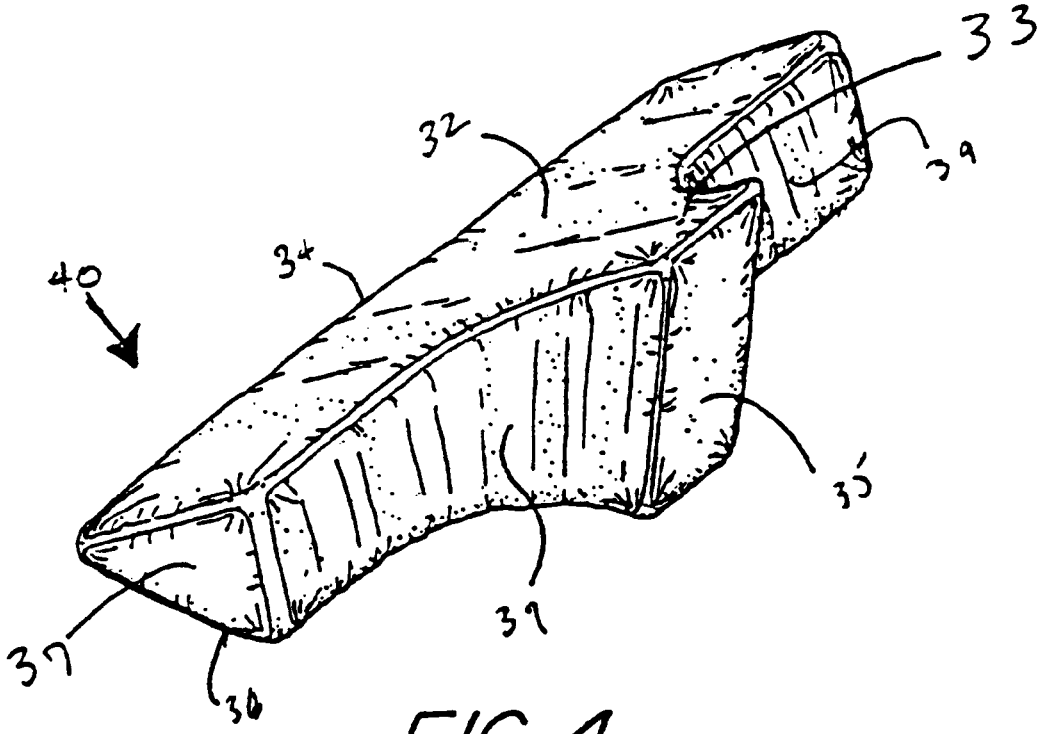
FIG. 4 is a perspective drawing of a an alternative embodiment of the invention.
Figure 5:
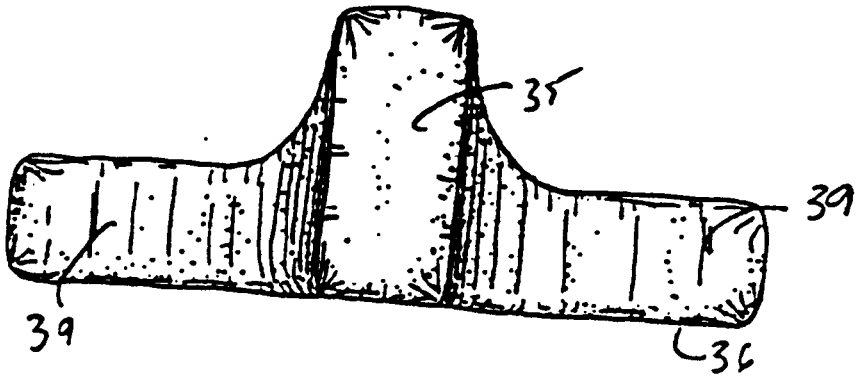
FIG. 5 is a front view of the alternative embodiment shown in FIG. 4.
Figure 6:
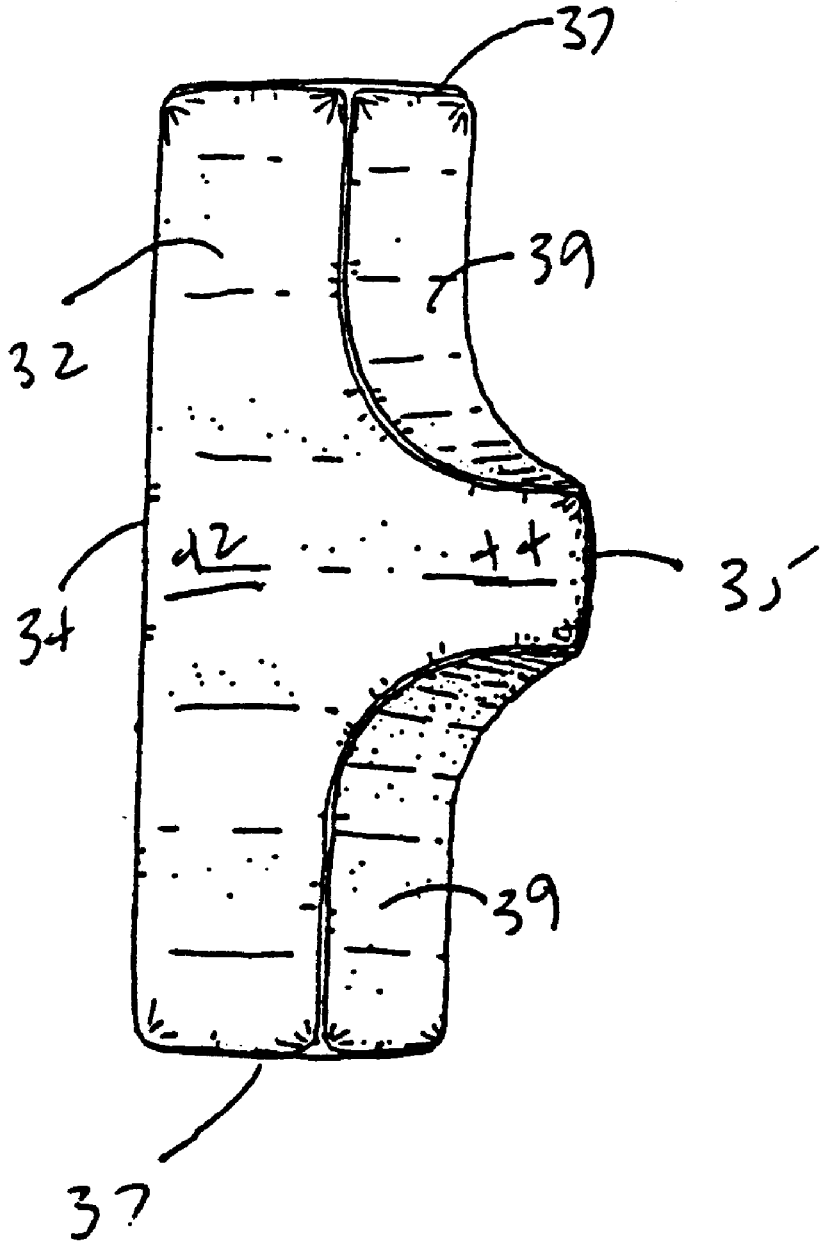
FIG. 6 is a top plan view of the alternative embodiment shown in FIG. 4.

An alternative embodiment of the invention is illustrated in FIGS. 4, 5 and 6. The cushion support 40 is similarly constructed of a foam rubber material or the like, and is used to support the breasts of a woman lying in a prone position by bolstering the breasts forward. Cushion support 40 enables women who have undergone breast surgery to lie or sleep on their stomach, and is particularly beneficial in the case of breast implants.

As in the preferred embodiment, the foam rubber material should be of a relatively firm grade so as not to collapse under the weight of the user. The basic form of the cushion support 40 is a substantially wedge-shaped elongate portion of foam rubber material, the upper and lower edges of the wedge being the longer sides of the cushion support 40, and comprising the front and rear edges respectively. The cushion support 40 has a top surface 32, bottom surface 36, posterior edge 34, and side surfaces 37. The front surface of cushion support 40 is defined by central front face 35 and adjacent concave arcuate breast support surfaces 39. Proximate to the side surfaces 37, breast support surfaces 39 are inclined at an angle opposite the angle of inclination of top surface 32. The portions of breast support surfaces 39 adjacent to central front face 35 are vertically oriented.

The basic form of the cushion support 40 is that of a right triangle-shaped wedge, and therefore front surface 35 is perpendicular to bottom surface 36, and top surface 32 is inclined at an angle of approximately 45° to the horizontal. As shown in FIG. 6, a lower rib cage support section 42 is defined by the lower portion of top surface 32 bounded by side surfaces 37. The upper protruding portion of top surface 32 bounded by cushion support surfaces 39 functions as sternum support section 44.

When a woman wishes to lie or sleep in a face down position, the cushion support 40 is positioned so that lower rib cage support section 42 is aligned with the area just beneath the breasts, and sternum support section 44 is centered between the breasts so that the breasts depend downwardly onto adjacent breast support surfaces 39. Bottom surface 36 is placed on a bed or other horizontal support surface. In use, the body of the user presses downward on cushion support 40, and breasts are supported by breast support surfaces 39 so as to urge the breasts forwardly somewhat. This positioning of the breast is beneficial to a woman who has undergone breast surgery as downward pressure on the breasts can be particularly uncomfortable.

The invention is capable of taking a number of specific forms without departing from the spirit or essential attributes thereof. Accordingly, reference should be had to the following claims, rather than the foregoing specification, as indicating the scope of the invention.

I claim:

1. A cushion support to be used by a female person lying in a prone position on a support surface, comprising:

an elongated block of foam material, said block of foam material having a planar lower face to be placed on the support surface, an upper face adapted to receive and support the torso of a female person lying in a prone position, side faces between the upper and lower faces, a rear end surface, and a front end surface;

said support having a width defined by the distance between the side faces and a length defined by the distance between the end surfaces;

said front end surface having a pair of oppositely disposed contoured recesses adapted to receive the breasts of a female person lying in a prone position, wherein said contoured recesses have a central protrusion therebetween, said central protrusion having a width less than the width of the support and a length less than the length of the support, and said central protrusion adapted to support the sternum of a female person and cooperates with said contoured recesses to reduce contact between the breasts and at least one of said cushion support and the support surface while a female person is lying in a prone position.

2. The cushion support of claim 1, wherein said upper face is defined by a surface having a planar front section parallel to said lower face and a rear section downwardly inclined from said front section.

3. The cushion support of claim 1, wherein said contoured recesses are vertically oriented.

4. The cushion support of claim 1, wherein said width and length of said block of foam material are sufficient in size to support a human torso.

5. The cushion support of claim 1, wherein said front end surface has a height, and said height is sufficient to prevent the breasts from substantially impacting against the support surface.

6. The cushion support of claim 1, wherein the cushion support has a closely conforming fabric cover.

7. A cushion support to enable a female person to lie in a prone position on a support surface without constraining or constricting the breasts, comprising:

an elongated block of foam material;

said block of foam material having a planar lower face to be placed on a horizontal support surface, an upper face having a horizontally oriented front section adapted to receive and support the upper torso of a female person lying in a prone position, side faces between the upper and lower faces, a rear end surface, and a front end surface;

said support having a width defined by the distance between the side faces and a length defined by the distance between the end surfaces;

said front end surface having contoured recesses adapted to receive the breasts of a female person lying in a prone position, wherein said contoured recesses have a central protrusion therebetween adapted to support the sternum of a female person lying in a prone position, said central protrusion having a width less than the width of the support and a length less than the length of the support; and said front end surface having a height sufficient to allow the breasts of a female person to depend into the recesses without contacting said support surface, whereby the breasts of a female person lying in a prone position may be freely suspended into said recesses without contacting said support surface or said cushion support.

8. A cushion support to enable a female person to lie in a prone position without constraining or constricting the breasts, comprising:

an elongated block of foam material of a length and width sufficient to support a human torso;

said block of foam material comprising an upper surface having a horizontally oriented upper rib cage support section, a horizontally oriented sternum support section, and a downwardly inclined lower torso support section;

said block of foam material further comprising a lower surface, side surfaces defined between the upper and lower surfaces, a rear end surface and a front end surface having contoured recesses adapted to receive the breasts of a female person lying in a prone position;

the length of the block of foam material defined by the distance between the end surfaces and the width of the block of foam material defined by the distance between the side surfaces; and wherein the upper rib cage support section is located between the recesses, said upper rib cage support section having a width less than the width of the block and a length less than the length of the block, whereby when a female person is lying in a prone position the lower torso is supported by the lower torso support section, the upper rib cage is supported by the upper rib cage support section, and the sternum is supported by the sternum support section, thereby allowing the breasts of a female person to be freely suspended without pressure being exerted on the breasts by the support surface or the cushion support.

9. A cushion support for the breasts of a woman lying in a prone position, comprising:

foam material having a planar bottom surface to be placed on a support surface, a top surface, side surfaces between the top and bottom surfaces, a front surface and a rear surface;

wherein the cushion support has a width defined by the distance between the side surfaces and a length defined by the distance between the front and rear surfaces;

wherein said top surface is inclined with respect to said bottom surface, said top surface including a lower portion adapted to support the lower rib cage of a woman lying in a prone position, an upper portion adapted to support the sternum of a woman lying in a prone position, and a horizontal upper rib cage support section;

wherein said front surface includes a central front face and oppositely disposed arcuate breast support surfaces adjacent to said central front face, said central front face being substantially perpendicular to said bottom surface, said arcuate breast support surfaces adapted to receive the breasts of a woman lying in a prone position; and wherein said upper rib cage support section is located between the arcuate breast support surfaces, said upper rib cage support section having a width less than the width of said block and a length less than the length of said block.

10. The cushion support of claim 9, wherein said top surface is inclined at an angle of approximately 45° with respect to said bottom surface.

11. The cushion support of claim 9, wherein said front surface has a height, said height being sufficient to prevent the breasts from substantially impacting against the support surface.

12. The cushion support of claim 9, further comprising a closely conforming fabric cover.

* * * * *